United States Patent [19]

Hibbs et al.

[11] 4,346,658

[45] Aug. 31, 1982

[54] ROCKET MOTOR ARMING-FIRING DEVICE FSU-12/B

[75] Inventors: Joseph E. Hibbs; Gerald W. Chalmers, both of Ridgecrest; Walter J. Teixeira, Canyon Country, all of Calif.

[73] Assignee: The United States of America as represented by the Secretary of the Navy, Washington, D.C.

[21] Appl. No.: 148,856

[22] Filed: May 12, 1980

[51] Int. Cl.[3] ..... F42C 15/06

[52] U.S. Cl. ..... 102/254; 60/39.82 E; 89/1.814; 102/262; 102/380

[58] Field of Search ..... 102/254, 262, 202, 200, 102/379, 380; 89/1.807, 1.812, 1.813, 1.814; 60/39.09 R, 39.82 E, 256

[56] References Cited

U.S. PATENT DOCUMENTS

| | | | |
|---|---|---|---|
| 3,052,784 | 9/1962 | Ousley | 102/262 |
| 3,408,937 | 11/1968 | Lewis et al. | 102/201 |
| 3,658,009 | 4/1972 | Allen | 102/254 |
| 4,019,441 | 4/1977 | Morgan et al. | 102/262 |
| 4,036,144 | 7/1977 | Meek | 102/254 |
| 4,046,076 | 9/1977 | Hampton | 102/262 |
| 4,278,026 | 7/1981 | Hibbs et al. | 102/254 |

*Primary Examiner*—Charles T. Jordan

*Attorney, Agent, or Firm*—Robert F. Beers; W. Thom Skeer; Luther A. Marsh

[57] ABSTRACT

An improved arming-firing device that provides handling safety in a rocket motor. The arming-firing device provides pyrotechnic (out-of-line) and electrical (open and shortened initiator circuits) safety features wherein the arming-firing device is armed by rotating an assemblage of a mechanical rotor switch assembly, and solenoid wherein the solenoid aligns multiple cavities of the mechanical rotor with multiple prongs of a kinetic energy barrier assembly ad this action simultaneously electrically arms (closes circuits and removes shots) and mechanically enables the initiator whereupon receiving a firing signal fires and in turn ignites the ignitor of the rocket motor. The mating of the kinetic energy poppet-sleeve squib assembly's barrier prongs with the rotor cavities obviates rebounding, thus affording proper ignition. The mechanical barrier and a solenoid return spring prevents inadvertent firing from any cause.

12 Claims, 3 Drawing Figures

ROCKET MOTOR ARMING-FIRING DEVICE FSU-12/B

BACKGROUND OF THE INVENTION

Various electro-mechanical arming-firing means have been and currently are used to maintain a guided missile in an unarmed position until it is ready for launching. One of the various types are illustrated in FIG. 1. The proliferation of so many different arming-firing means has created inadequate ordnance safety. Some safety failures have been catastrophic, especially when they have occurred aboard ships.

This invention illustrates an arming-firing means that can be utilized with many guided missiles systems and is an improvement invention over U.S. Pat. No. 4,278,026 issued July 14, 1981 and filed Oct. 15, 1979 which is incorporated herein by reference. The utilization of a safe arming-firing device that is compatible with many guided missile systems is an absolute necessity in view of accidental ignition frequency as shown in FIG. 2 of the above cited U.S. Patent application Ser. No. 084,487 dated Oct. 15, 1979.

SUMMARY OF THE INVENTION

The arming-firing device of the present invention provides an improved safe arming-firing device which can interface with many guided missile systems. This invention uses an electrically inititated translating poppet-sleeve squib assembly (EID), as described and claimed in U.S. Pat. No. 4,046,076, and assigned to same assignee, as a part of the safe arming-firing device of this invention. The description of the (EID) as described and claimed in U.S. Pat. No. 4,046,076 is also incorporated herein by reference.

The arming-firing device of this invention is armed by rotating, an improved mechanical rotor having multiple cavities therein in line with a translating poppet-sleeve squib assembly with an improved mechanical barrier having multiple prongs located and attached at the forward end of the sleeve squib assembly, forty five degrees. The mechanical barrier is newly redesigned to be sixty percent of its former size and when affixed within its assemblage incorporates O-rings which reduces the kinetic energy upon impact thus preventing degradation to the solenoid assemblage. The rotary motion is brought about by a solenoid using lesser energy than motors heretofore used in this function. A torsional return spring attached at the base of the solenoid automatically rotates the mechanical rotor back to a safe position if during the missile arming and firing sequence, the arming voltage is removed or if there is an electrical malfunction which causes loss of electrical power to the arming firing device. Upon activation of the arming-firing sequence the moment of inertia of the torsional return spring is overcome thus allowing the rotor to align with the barrier. The moment of force within the return spring automatically rotates the mechanical rotor back to a safe position in case of any malfunction. The automatic resafing of this invention is proven by over fifty thousand activations in qualification testing and actual fleet usage of the missile qualified solenoid. The poppet-sleeve squib assembly is keyed by insulator/insert and retained in place by a shear pin to eliminate any movement under ship or other transportation vibrations.

The arming-firing device of the present invention also provides a newly developed image conduit system which allows visual inspection of the arming-firing device to determine whether the device is in a safe or armed condition. The image conduit system brings the image or safe (S) or armed (A) to the surface allowing the image to be clearly seen.

BRIEF DESCRIPTION OF THE DRAWINGS

Illustrative examples of the present invention are illustrated in the accompanying drawings wherein.

DESCRIPTION OF THE PREFERRED EMBODIMENTS

Figure 1:
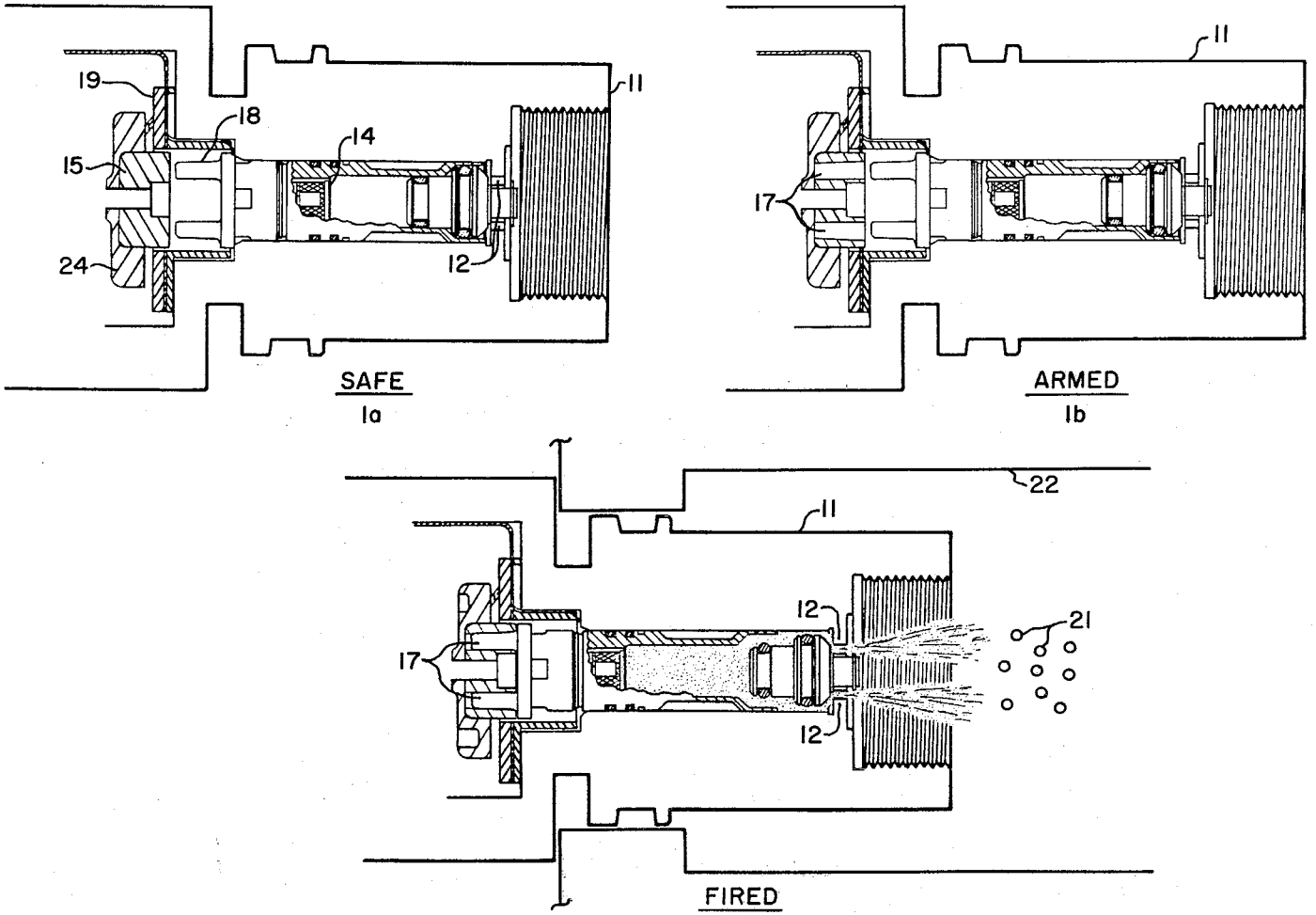
FIG. 1 is a longitudinal sectional view of a arming-firing device illustrated in a safe, armed and fired condition.
Figure 2:
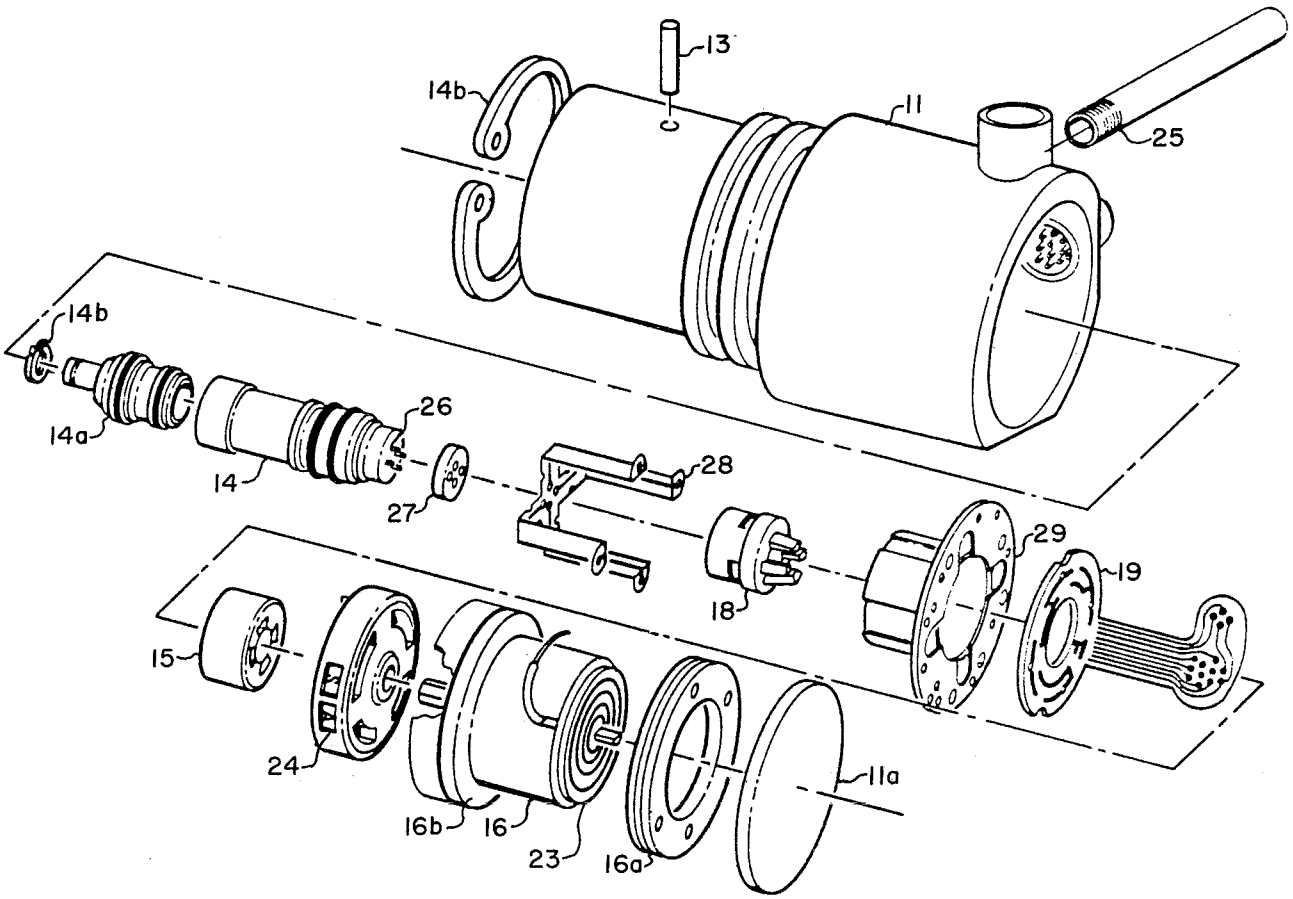
FIG. 2 is a perspective exploded view of detailed parts of the complete arming-firing device with newly developed image conduit system and its relationship to the overall arming-firing device.
Figure 3:
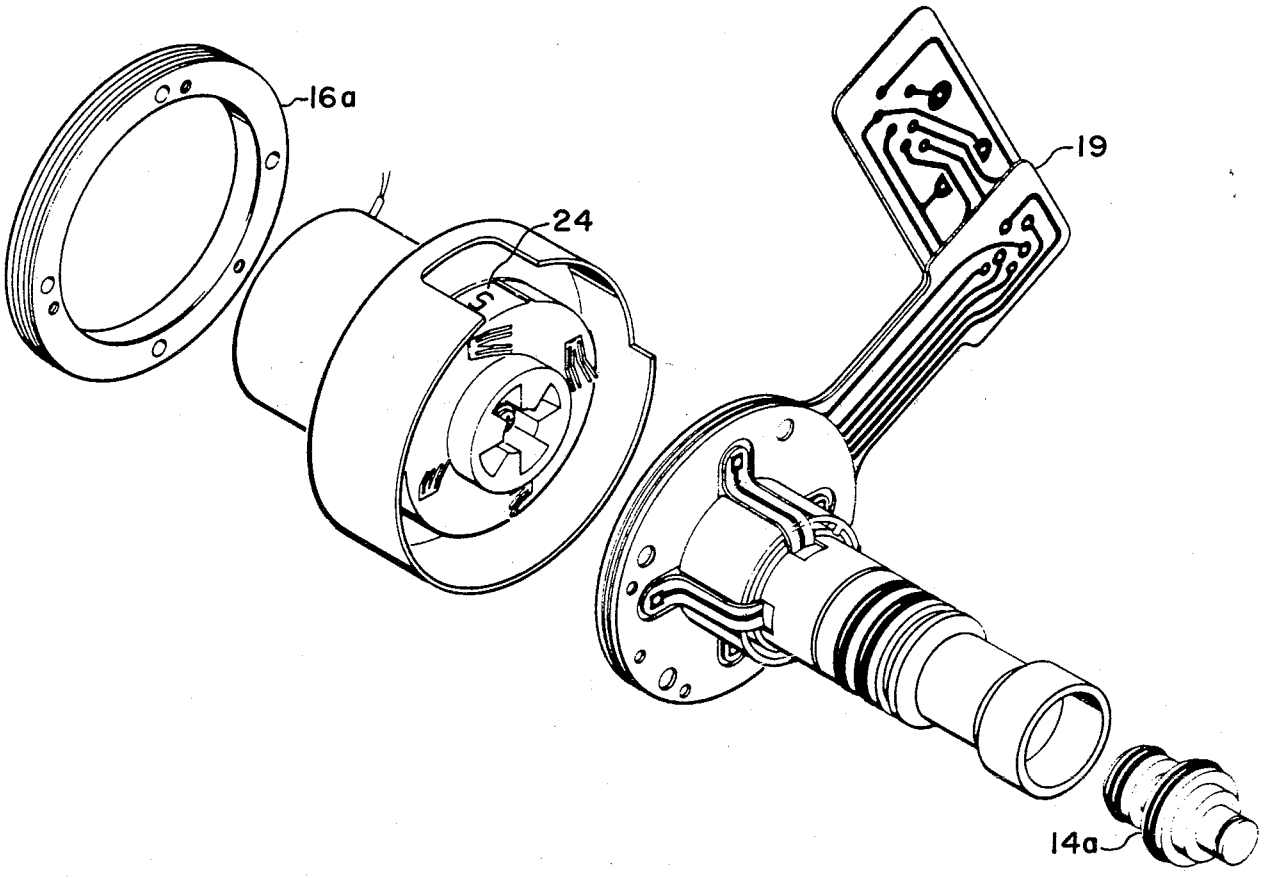
FIG. 3 is a longitudinal view of the overall universal internal assembly of a arming-firing device.

Referring now to the drawings in FIGS. 1, 2 and 3 wherein like reference numerals correspond to like parts and elements through the several figures there is shown in FIG. 1 an elongated cylinder housing 11 wherein resides an electrically initiated translating poppet-sleeve squib assembly 14. A solenoid 16 rotation aligns multiple tapered cavities 17 of the rotor with multiple barrier tapered prongs 18 located forward of poppet-sleeve squib assembly 14 and attached thereto. Upon application of arming power, the arming-firing device automatically arms electrically and mechanically. That is, all electrical circuits 19 are automatically closed upon mechanical alignment of barrier prongs 18 and rotor cavities 17. The tapered barrier prongs 18 and rotor cavities 17, upon alignment and firing, provide an interference which locks the two together with a wedging action, and thus prevents rebounding. The elimination of rebouding upon firing allows the arming-firing device upon receipt of a firing signal to initiate the poppet-sleeve squib assembly 14 which upon initiation, its gas pressure causing the poppet-sleeve squib assembly 14 to translate forward with respect to housing 11, opening vent ports 12. This motion causes hot gases from the poppet-sleeve squib assembly 14 to reach igniter pellets 21 through vent ports 12, thus igniting the igniter pellets 21 and starts rocket motor 22 burning. The wedging action caused by mating tapered barrier prongs 18 and rotor cavities 17 allows positive ignition of igniter pellets 21 by eliminating rebounding of poppet-sleeve squib assembly 14, thus allowing positive ignition of rocket motor 22.

Torsional coil spring 23 engages solenoid 16 at all times and, prior to mechanical enabling, and upon inadvertent initiations of poppet-sleeve squib assembly 14 or if during missile arming and firing sequence the arming voltage is removed or an electrical malfunction causing loss of electrical power, it rotates mechanical rotor 15 back to the safe position. Exhaustive tests of automatic resafing of spring 23 has been proven in qualification testing and actual usage.

A switch/indicator 24 is attached to rotating solenoid 16 and so positioned wherein positive visual inspection of safe or armed condition of arming-firing device is shown by observation viewer 25 utilizing an image conduit. The observation viewer allows viewing of switch/indicator 24 from outside rocket motor 22.

FIG. 2 further illustrates a perspective exploded view of detailed parts of the improved arming-firing device of this invention. The newly designed detailed parts—poppet 14*a*, poppet-sleeve squib assembly 14, barrier 18, insulator/insert 29, switch plate assembly 19, solenoid 16, image conduit 25, rotor 15 and switch/indicator assembly 24 of FIGS. 1, 2 and 3 are further illustrated in terms of their function and advantages.

Newly designed poppet 14*a* and poppet-sleeve squib assembly 14 gives much greater efficiency because the hot gas pressure exits axially in this invention rather than radially. Insulator/insert 29, is comprised of a barrier alignment pin and insulator. It is not only more economical and easier to handle, but it is designed to sit flat in assembled condition with the switch plate assembly 19. The integral switch/indicator assembly 24 contains pockets which are molded for contacts, along with molded indicator letters ('S' & 'A') rather than the two piece contact holders used in previous designs. The image concuit 25 made up from many clad rods of fiber optics into a one fourth inch bundle, also called a coherent array of elements, gives a positive visual inspection of safe or armed condition of the arming-firing device at the surface of the rocket motor 22. The newly designed forward flex-print allows the solenoid's leadwires to extend through a tubelet of the flex-print and solder directly rather than connecting the lead wires to a connector pin and solder it as previously. The solenoid 16, rotor 15, and switch/indicator assembly 24 are integrated into an assembly from integral universal sub-assembly parts. This integration here eliminates customizing of each part as previously done. The solenoid endplate 16*b* is now an integral part of solenoid assembly 16 and eliminates a small shoulder located in old solenoid end plate interface which was a weak link in the heart of the design. FIG. 1 further illustrates a sectional view of detailed interrelationships of rotor 15 barrier prongs 18, rotor cavities 17, and vent ports 12.

The advantages of the safe arming-device of this invention are many. A totally rotary solenoid 16 is utilized which eliminates motors used previously, has an attached torsional coil spring 23 which if any malfunction occurs in the energy source, prior to firing the arming-firing device, returns the solenoid 16 and mechanical rotor 15 to a safe position. Upon applications of power to solenoid alignment of rotor tapered cavities 17 and barrier tapered prongs 18, is accomplished as part of the launch sequence and eliminates manual arming. Another advantage is in the redesign of the functional parts wherein they are precision made sub-assemblies that can interface with any missile system. Such precision sub-assembly yields great efficiency and cost effectiveness.

A further advantage is the mechanical out-of-line rotor 15/barrier 18 which prevents inadvertent igniter initiation. The rotor 15/barrier 18 combination when fired in the armed condition as shown in FIG. 1 prevents any rebound through their wedging action thus allowing positive initiation of igniter pellets 21.

Yet another advantage of the arming-firing device of this invention is that it is designed to interface with any missile system. This allows use in multiple weapon systems thus results in a higher confidence level for the determination of safety feature reliability.

Still another advantage is the use of improved fiber optics allowing viewing outside of the missile for inspection of the arming-firing device to determine whether the unit is in the safe or armed condition.

Other advantages through modifications to the basic teaching of the safe arming-firing are available to those skilled in the art.

The embodiments illustrated are exemplary and variations can be made in construction and arrangement within the invention's scope as defined in the appended claims.

What is claimed is:

1. A arming-firing device for preventing unintentional ignition of a rocket motor, comprising:

a housing defining a plurality of axial vent ports;

a poppet-sleeve squib assembly attached with said housing venting through a plurality of axial ports;

a poppet located within said poppet-sleeve squib assembly preventing axial venting of said arming-firing device in the 'safe' position;

a rotary solenoid having sub-assemblies, switch/indicator assembly and a rotor, having multiple cavities therein and located aft of a solenoid lock ring and forward of said poppet-sleeve squib assembly;

a barrier and sub-assembly having multiple prongs designed to fit said cavities in said rotor located between said rotor and said poppet-sleeve squib assembly;

said barrier interconnected with said poppet-sleeve squib assembly;

a solenoid return spring attachably interconnected to said rotor; and an image conduit viewer attached through said housing providing a viewing surface as to whether device is armed or not.

2. The arming-firing device of claim 1 wherein;

said poppet-sleeve squib assembly is keyed by insert/insulator and retained by a shear pin.

3. The arming-firing device of claim 1 wherein;

said rotor cavities are tapered.

4. The arming-firing device of claim 1 wherein;

said barrier prongs are tapered.

5. The arming-firing device of claim 1 wherein;

said solenoid spring is a torsional spring.

6. The arming-firing device of claim 1 wherein;

said image conduit viewer is for positive inspection of said switch/indicator to ascertain whether device is safe or armed.

7. A arming-firing device for preventing unintentional ignition of a rocket motor, comprising;

a housing means having a plurality of axial vent ports;

a poppet-sleve squib assembly means attached within said housing means for ignition of said rocket motor;

a rotary solenoid means located forward of said poppet-sleeve squib assembly, having multiple cavity rotor attached, for rotation of said rotor to an armed position when subjected to an input signal;

a barrier means located between said rotor and said poppet-sleeve squib assembly and interconnected thereto and having multiple prongs defined to fit said cavities in said rotor for giving a wedging action to the barrier and rotor, thus attenuating rebound of the barrier and interference with ignition of the rocketmotor;

a solenoid return spring means adjacently interconnected to said rotor for rotating said rotor to a safe position if during arming and firing sequence the arming voltage is removed or if there is an electrical malfunction which causes loss of electrical power to said safety-arming device; and a viewer means for providing a viewing surface as to whether device is armed or not.

8. The arming-firing device of claim 7 wherein;

said poppet-sleeve squib assembly is keyed by insert-/insulator and retained by a sheer pin for the elimination of any moment under transportation vibrations.

9. The arming-firing device of claim 7 wherein;

said rotor cavities are tapered for interlocking said barrier prongs to prevent any rebound and thus allowing proper initiation of said igniter means.

10. The arming-firing device of claim 7 wherein:

said barrier prongs are tapered for interlocking within said rotor cavities to prevent any rebound and thus allowing proper ignition of said igniter means.

11. The arming-firing device of claim 7 wherein:

said solenoid spring means is a torsional spring for rotating said rotor back to a safe position in the event of any malfunction.

12. The arming-firing device of claim 7 wherein:

said image conduit viewer means is so designed to provide a viewing surface as to whether device is armed or not.

* * * * *